US007043172B2

(12) United States Patent
Koshimura et al.

(10) Patent No.: US 7,043,172 B2
(45) Date of Patent: May 9, 2006

(54) IMAGE FORMING APPARATUS

(75) Inventors: Yasushi Koshimura, Hino (JP); Junichi Koiso, Hachioji (JP); Kanehiro Watanabe, Sagamihara (JP)

(73) Assignee: Konica Minolta Business Technologies, Inc., (JP)

( * ) Notice: Subject to any disclaimer, the term of this patent is extended or adjusted under 35 U.S.C. 154(b) by 55 days.

(21) Appl. No.: 10/830,269

(22) Filed: Apr. 21, 2004

(65) Prior Publication Data

US 2005/0031370 A1 Feb. 10, 2005

(30) Foreign Application Priority Data

Aug. 5, 2003 (JP) ..... 2003-286682

(51) Int. Cl.
*G03G 21/00* (2006.01)

(52) U.S. Cl. ..... 399/99; 399/92; 399/93; 399/119

(58) Field of Classification Search ..... 399/92, 399/93, 98, 99, 100, 101, 107, 119
See application file for complete search history.

(56) References Cited

U.S. PATENT DOCUMENTS 6,813,457 B1 * 11/2004 Yoshiki ..... 399/92

FOREIGN PATENT DOCUMENTS

JP 08-220882 8/1996

* cited by examiner

*Primary Examiner*—Hoang Ngo
(74) *Attorney, Agent, or Firm*—Cantor Colburn LLP

(57) ABSTRACT

An image forming apparatus may comprise a suction section, fitted onto the air vent, for sucking toner particles scattered in the image forming apparatus, including an intermediate duct in which the toner particles accumulate and which is detachable from the suction section, and an exhaust fan for sucking air including the toner particles, through the intermediate air duct, and discharging air outside the image forming apparatus.

4 Claims, 3 Drawing Sheets

IMAGE FORMING APPARATUS

BACKGROUND OF THE INVENTION

The present invention relates to an image forming apparatus having therein a developing means which can be installed in a copying machine, printer or facsimile, each of which use an electronic photographic method.

In recent years, in the field of electronic photography, required is higher durability of a developer (which is toner), and a longer maintenance cycle. Specifically, regarding the higher durability of the developer, the big problem is scattering of the developer.

Developers having a lower amount of electrical charge, are scattered by the rotation of developer carrier (which is a developing sleeve), which faces the image carrier (which is a photoconductor drum), from the downstream of the developer carrier with respect to the rotating direction of the developer carrier. As a counter measure for the above problem, proposed is a developing means wherein an air vent of an air duct of a scattered developer suction means is formed as described in Patent Document 1, and the scattered developer is sucked through the air vent, and thereby, the image forming process members (which are structure members) or the transfer materials (which is sheets) are prevented from being dusted with stray developers.

[Patent Document Japanese Tokkaihei 8-220882]

However, in the image forming apparatus providing the above-mentioned developing means, the developers scattered from the developing means accumulate in the air duct of the scattered developer suction means, and the air vent is blocked, requiring periodic cleaning. Further, when the user cleans the scattered developer suction means installed in the developing means or its air duct, it is very difficult for the user to make clean them, because the air duct is very thin.

SUMMARY OF THE INVENTION

An embodiment of the present invention provide an image forming apparatus having therein a developing means in which the above drawbacks are overcome, that is, the scattered developers do not block up the air vent of the air duct of the scattered developer suction means, and further the air duct and air vent are easily cleaned, and maintenance work is easily performed.

The above objectives are attained by an image forming apparatus which includes an image carrier, a charging means for evenly charging the image carrier, an image writing means for forming latent images on the image carrier which is charged by the charging means, a developing means for forming toner images on the image carrier by developing the latent images formed on the image carrier, a transfer means for transferring the toner images onto a transfer material, and a fixing device for fixing the toner images on the transfer material, wherein a scattered developer suction means, including an air duct for gathering the scattered developers in the developing means, is provided, and further, an intermediate duct, which can be detached from a section near the air vent connected to the developing means, is provided in the scattered developer suction means.

Since the present invention may be structured like above, the present invention may comprise an image forming apparatus, which may improve the condition that the scattered developers do not block up the air vent of the air duct of the scattered developer suction means, and thereby, it is very easy to clean the scattered developer suction means, the air duct and air vent, and also proposes an image forming apparatus having therein the developing means featured improved maintenance ease.

DETAILED DESCRIPTION OF THE PREFERRED EMBODIMENT

Embodiment of the present invention will be explained in detail below. The description in this embodiment does not limit the technical scope of the claims nor the meaning of terms. Further the assertive explanation in the embodiment of the present invention shows the best condition, but does not limit the technical scope nor the meaning of terms in the present invention.

The image forming apparatus provided with the developing means relating to the present invention will be described as follows, while referring to FIG. 1.

Figure 1:
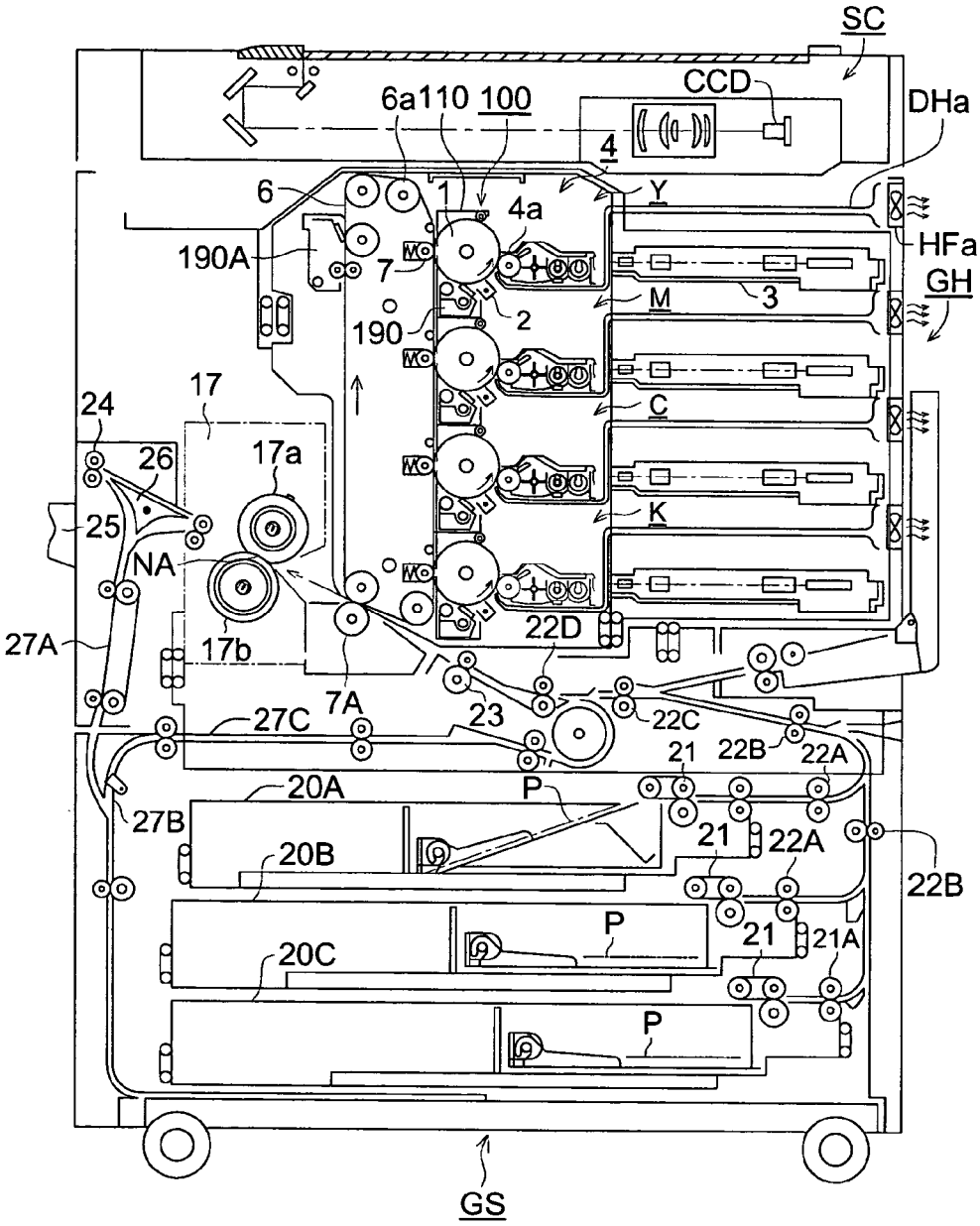
FIG. 1 is a schematic view of an embodiment of a color image forming apparatus GS including a scattered developer suction means of the present invention.

In FIG. 1, image forming apparatus GS is structured by image forming apparatus main body GH, and image reading device SC mounted on image forming device main body GH.

Image forming apparatus main body GH is called a tandem type color image forming apparatus, wherein image forming units for forming color toner images of yellow, magenta, cyan and black are arranged for sequential conveyance in an intermediate transfer body, and wherein color toner images formed on image carriers of each image forming unit are superimposed onto the intermediate transfer body, and which are superimposed onto a transfer material.

In FIG. 1, a document is placed on image reading device SC which is disposed within image forming apparatus main body GH. The document is exposed by a scanning method via an optical system. Data of the document are read by line image sensor CCD, and are photo-electrically converted into analog signals by line image sensor CCD. The analog signals are converted to the digital signals by an image processing section, and next, shading correction and image compression are conducted onto the digital signals to image data signals, after which the image data signals are sent to exposure optical systems 3, being the image reading means.

Further in FIG. 1, around intermediate transfer belt 6, which is the intermediate transfer body, four sets of process units 100, which are the forming means of the color toner images and serve for image formation of each of the colors of Y (yellow), M (magenta), C (cyan) and K (black), are arranged vertically to contact intermediate transfer belt 6, in the order of Y, M, C and K, with respect to the vertical rotation of intermediate transfer belt 6, shown by an arrow in FIG. 1.

The four sets of process units 100 are formed in a common structure, each being provided with photoconductor drum 1 which is the image carrier, charging device 2 which is the charging means, exposure optical system 3 which is the image writing means, developing device 4 which is the developing means mentioned later, and photoconductor cleaning device 190 which is the image carrier cleaning means.

Photoconductor drum 1, which is the image carrier, is formed in the following way. That is, photoconductive layer, structured by 20–40 μm organic photoconductor layer (OPC), is formed on the surface of a cylindrical body whose outside diameter is 40–100 mm, made of a metal such as aluminum. Photoconductor drum 1 is rotated, by motive energy from a driving source which is not illustrated, at a line speed of 80–280 mm/s, or more preferably 220 mm/s, in the direction of the arrow shown in FIG. 1, under the condition that the electrical conducting layer is grounded.

Around photoconductor drum 1, disposed is an image forming section provided with charging device 2 as the charging means, exposure optical system 3 as the image writing means, and developing device 4 as the developing means, all of which are structured into a set. This image forming section is disposed around photoconductor drum 1 in the rotating direction of photoconductor drum 1, which is shown by the arrow.

Charging device 2 as the charging means faces and is also adjacent to photoconductor drum 1 across the full width at a small clearance. Charging device 2 uses a wire as a corona discharging electrode which places a predetermined electric potential onto the organic photoconductive layer of photoconductive drum 1, and thereby, performs a charging function (which is negative charging in the present embodiment) by corona discharge of the same polarity on the toner, which gives uniform electric potential onto photoconductive drum 1.

Exposure optical system 3 as the image writing means enables laser rays radiated from a semiconductor laser (LD) source, which is not illustrated, to rotationally scan the document by a polygon mirror, which is also not illustrated, in the main scanning direction. Exposure optical system 3 performs the exposure (which forms the image) onto photoconductive drum 1 using electrical signals corresponding to image signals which have passed through an fθ lens and a reflector lens, (neither of which have identifying numerals), and therefore, exposure optical system 3 forms an electrostatic latent image corresponding to the document onto the surface of the photoconductive layer on photoconductive drum 1.

Developing devices 4 as the developing means respectively accommodate two-component developers for yellow (Y), magenta (M), cyan (C) or black (K), all of which are charged at the same polarity as photoconductive drum 1. Each developing device 4 has developing roller 4*a* as a developer carrier which is formed of nonmagnetic stainless steel or aluminum, which is cylindrical at a thickness of 0.5–1.0 mm , and a diameter of 15–25 mm. Developing roller 4*a* is maintained at a clearance of 100–1000 μm against photoconductive drum 1 by a stopper (which is not illustrated). Developing roller 4*a* and photoconductive drum 1 rotate counterclockwise in FIGS. 2 and 4. While developing, a developing bias voltage, which is a direct voltage or a direct voltage added onto an alternate voltage, and which is the same polarity of the toner (negative in the present embodiment), is impressed onto developing roller 4*a*, and thereby reversal development is conducted onto the exposed section on photoconductive drum 1. Concerning the developer (which is the toner) for the reversal development, styrene/acryl polymerization toner is used. Toner scattered between photoconductive drum 1 and each developing device is exhausted to the outside by exhaust fan HFa through development suction GSa and exhaust duct DHa.

Intermediate transfer belt 6 which is the intermediate transfer body, has a volume resistivity of about $1.0\times10^{7}$–$1.0\times10^{9}$ Ωcm, while its surface resistivity is $1.0\times10^{10}$–$1.0\times10^{12}$ Ωcm. Intermediate transfer belt 6 is a looped belt (being a seamless belt) made of a semi-conductive resin material, whose base is made by such a way that a conductive material is deployed onto an engineered plastic such as modified polyimide, thermally hardened polyimide, ethylene tetrafluoroethylene copolymer, poly fluoride vinyliden, and nylon compound alloy, and which is a semi-conductive film member at a thickness of 0.05 to 0.5 mm. Another type of base of intermediate transfer belt 6 can be a semi-conductive rubber belt at a thickness of 0.5 to 2.0 mm, which is made in such a way that the conductive material is deployed onto a silicon rubber or urethane rubber layer. Intermediate transfer belt 6 is entrained about a plurality of roller members including tension roller 6*a*, and rotates clockwise. A drum shaped intermediate transfer body can also be employed.

Primary transfer roller 7 which is a primary transfer member for each color is formed of a roller shaped electroconductive member made of foamed rubber such as silicon or urethane, and primary transfer roller 7 faces photoconductive drum 1 of each color, with intermediate transfer belt 6 sandwiched in between, and presses intermediate transfer belt 6 from behind so that a transfer area is formed between photoconductive drum 1 and primary transfer roller 7. A constant direct current, having polarity opposite (a positive polarity in the present embodiment) of the toner, is impressed onto primary transfer roller 7 by a constant current controller, and therefore, the toner image on photosensitive drum 1 is transferred onto intermediate transfer belt 6 by an electrical transfer field formed at the transfer area.

An image forming process will now be explained.

When image recording is started, a photoconductive member starting motor which is not illustrated begins rotation and thereby Y (yellow) photoconductive drum 1 is rotated in the arrowed direction in FIG. 1, resulting in that an electrical potential is impressed onto photoconductive drum 1 by Y charging device 2. After that, Y exposure optical system 3 performs the exposure (which forms an image), in accordance with the electrical signals corresponding to the yellow image data as first color signals, that is, an electrostatic latent image corresponding to the Y image is formed onto Y photoconductive drum 1. Then the reversal development is conducted on the electrostatic latent image by Y developing device 4, forming a toner image made of Y toner onto Y photoconductive drum 1. This Y toner image is then transferred onto intermediate transfer belt 6 by Y primary transfer roller 7.

Next, an electrical potential by M (magenta) charging device 2 is impressed onto photoconductive drum 1. After that, M exposure optical system 3 performs the exposure (which forms an image), in accordance with the electrical signal corresponding to the magenta image data as a second color signal, that is, an electrostatic latent image corresponding to M image is formed onto M photoconductive drum 1. After which reversal development is conducted on the electrostatic latent image by M developing device 4, forming a toner image made of M toner onto M photoconductive drum 1. Following that, this M toner image is superimposed onto Y toner image on intermediate transfer belt 6 by M primary transfer roller 7.

By the same process as mentioned above, a toner image made of C (cyan) toner formed on C photoconductive drum 1, and a toner image made of K (black) toner formed on K photoconductive drum 1, are sequentially superimposed onto Y and M toner images on intermediate transfer belt 6, that is, superimposed color toner images of Y, M, C and K are formed on the looped surface of intermediate transfer belt 6.

Remaining toner on each photoconductive drum 1 after the transfer is cleaned by photoconductor cleaning device 190 which is an image carrier cleaning means.

On the other hand, recording sheets P, which are transfer materials, accommodated in sheet feeding cassettes 20A, 20B and 20C, are conveyed by feed-out roller 21 and sheet feeding roller 22A, both of which are disposed in sheet feeding cassettes 20A, 20B and 20C, to secondary transfer roller 7A, which is a secondary transfer means, through conveyance rollers 22B, 22C and 22D, and registration roller 23. In this case, the voltage, whose polarity (positive polarity in the present embodiment) is opposite that of the toner, has been impressed onto secondary transfer roller 7A. At the transfer area of secondary transfer roller 7A, color toner images (which are color images), superimposed on intermediate transfer belt 6, are transferred in one pass onto recording sheet P.

Transferred sheet P on which the color images have been transferred, are fixed by heat and pressure at fixing nip section NA composed of heat roller 17*a* and pressure roller 17*b* of fixing device 17, after which, recording sheet P is nipped by paired sheet ejecting rollers 24 and is fed out onto sheet ejection tray 25.

Further, after color images are transferred onto recording sheet P by secondary transfer roller 7A as the secondary transfer means, intermediate transfer belt 6 is turned upward in order to separate recording sheet P, and then intermediate transfer belt 6 is cleaned by intermediate transfer body cleaning device 190*a* to remove any remaining toner.

Namely, in the above explanation of the image forming apparatus, color image formation is explained, however the present invention also applies to a monochromatic image formation.

Figure 2:
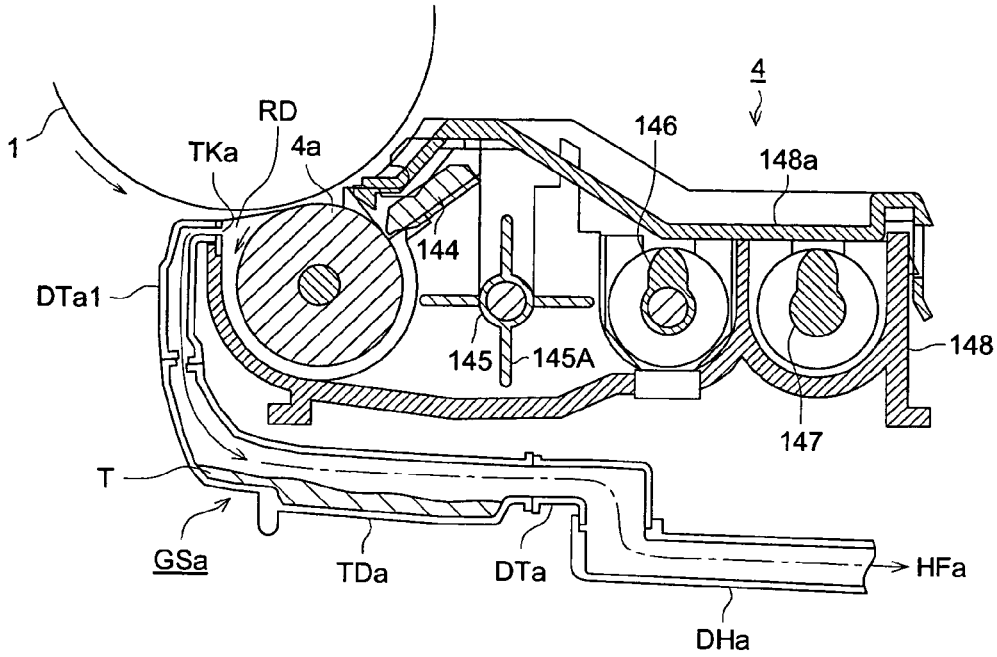
FIG. 2 is a sectional view of a developing means to which a scattered developer suction means of the present invention is connected.

Next, a developing means relating to the present invention will be explained, referring to FIGS. 2 and 3. FIG. 2 is a sectional view of the developing means of the present invention.

Figure 3:
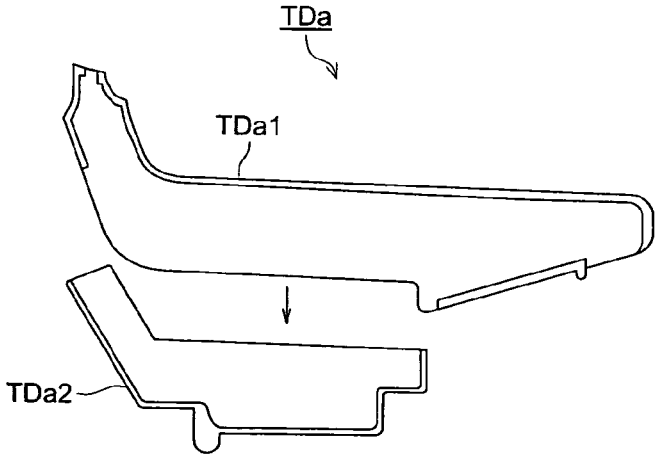
FIG. 3 shows an exploded view of an intermediate duct of the scattered developer suction means connected to the developing means.

FIG. 3 shows a separated structure of the intermediate duct TDa, composed of TDa 1 and TDa 2, of the scattered developer suction means GSa provided in the developing means 4.

In developing device 4, as the developing means related to the present invention, developing roller 4*a* is axially disposed parallel to the photoconductive surface of photoconductive drum 1 whose diameter is 100 mm, as shown in FIG. 2.

Developing device 4 accommodates two-component developers, and has developing roller 4*a* which secures a predetermined clearance between itself and the surface of photoconductive drum 1, both developing roller 4*a* and photoconductive drum 1 rotate counter clockwise as shown in FIG. 2.

Developing device 4 as the developing means is structured as follows.

Developing device 4 includes developer housing 148 which accommodates the two-component developers composed of a toner and a carrier, developing roller 4*a* as a developer conveyance member having therein a magnetic roller (which is not illustrated), layer thickness control member 144 which is formed of a magnetic material and controls the thickness of the developer on developing roller 4*a* in a predetermined amount, conveyance supplying roller 145, and paired agitating screws 146 and 147.

Developing roller 4*a*, which is the developer conveyance member, is composed of a nonmagnetic cylindrical member made of aluminum or stainless steel, with an outer diameter of 8–60 mm. Developing roller 4*a* is spaced at a predetermined distance from the surface of photoconductive drum 1 by a stopper (which is not illustrated). Since both developing roller 4*a* and photoconductive drum 1 rotate in the same direction, their rotation direction oppose each other at their closest approach. If the outside diameter developing roller 4*a* is less than 8 mm, it is not possible to form a magnetic roller (which is not illustrated) composed of five magnetic poles N1, S1, N2, S2 and N3 which are necessary for the image formation. If the diameter of developing roller 4*a* is greater than 60 mm, developing device 4 becomes too large. Specifically, in a color printer having plural sets of developing devices 4 (see FIG. 1), the volume occupied by the developing means is very large, that is, the outside diameter of photoconductive drum 1 is so great that the overall image forming apparatus becomes large-sized.

The magnetic roller, which is not illustrated, is an internal capsule in developing roller 4*a*. Plural magnetic poles N1, N2, N3, S1 and S2 are sequentially arranged (not illustrated), which are fixed concentrically within developing roller 4*a*, and which form the magnetic field on the peripheral surface of the nonmagnetic sleeve.

Layer thickness control member 144, which is the layer thickness control means, is formed of a rod-like or platey magnetic stainless steel for example, faces the north pole of the magnetic roller (which is not illustrated), and is disposed a predetermined clearance from developing roller 4*a*, therefore, layer thickness control member 144 controls the two-component developer formed on developing roller 4*a*, to a stable and uniform thickness. Specifically, the present method using layer thickness control member 144 which is a magnet method, is superior for forming a thick developer on the surface of developing roller 4*a*.

Conveyance supplying roller 145 conveys the developer which is removed from developing roller 4*a* to agitating screw 146, and further conveys the developer agitated by agitating screw 146 to layer thickness control member 144. Fin section 145A is mounted on conveyance supplying roller 145 to move the developer.

Agitating screws 146 and 147 rotate at the same speed in the opposite directions with respect to one another, and agitate and mix the toner and magnetic carrier in developing device 4, to produce the two-component developer which uniformly include the predetermined toner component.

Toner is supplied to developing device case 148 from a toner supplying outlet (which is not illustrated), and which is disposed above agitating screw 147 and also on top plate 148*a* located at the top section of developing device case 148.

Since agitating screws 146 and 147 rotate at the same speed in opposite directions with respect to one another, agitating screws 146 and 147 mix the developer accommodated in developing device case 148, to produce a developer having uniform toner density. Next, the developer is conveyed to layer thickness control member 144 by rotating conveyance supplying roller 145, further the developer is controlled to be at a predetermined thickness, and is supplied to the surface of developing roller 4*a*. After the developer develops the latent image on photoconductive drum 1, the developer is removed by developing roller 4*a*, and is conveyed to agitating screw 146 again by conveyance supplying roller 145. The developing bias voltage which is a DC bias or an AC bias superposed on DC bias is impressed onto electrostatic latent images on photoconductive drum 1, whereby the developing bias voltage conducts reversal development of the latent images by an non-contact developing method under a non-contact condition.

Figure 4:
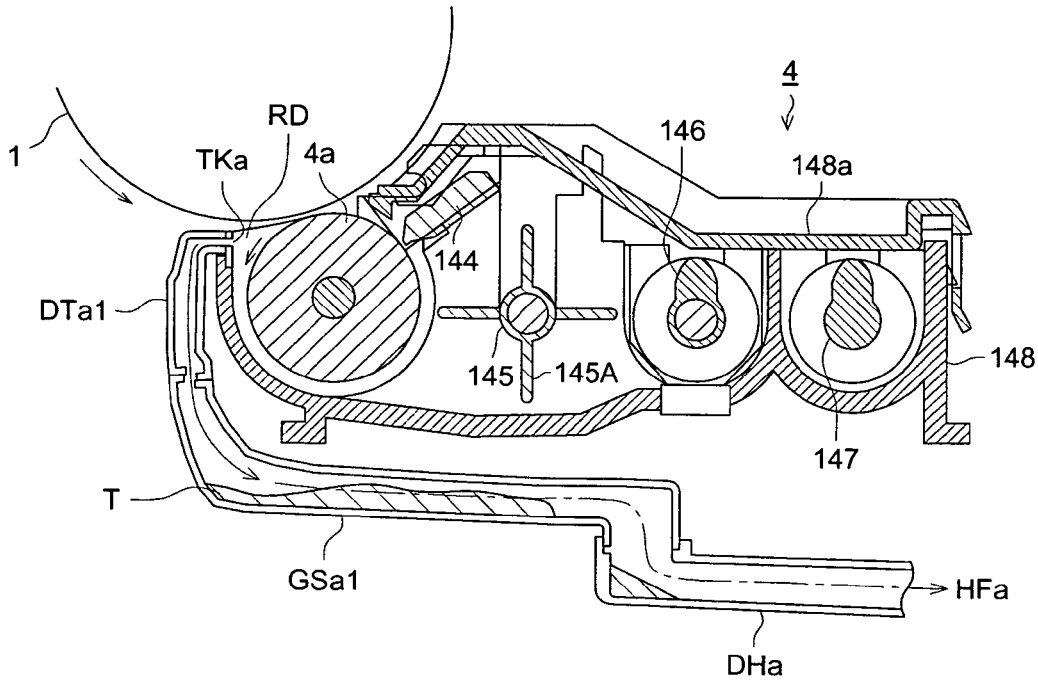
FIG. 4 PRIOR ART
FIG. 4 is a sectional view of a developing means to which a scattered developer suction means of the prior art is connected.

FIG. 4 shows developing device 4 incorporating the conventional scattered toner suction means GSa1.

Gap RD is located so that photoconductive drum 1 and developing roller 4*a* face each other.

Air vent TKa is mounted onto developing housing 148 near gap RD.

One end of 60–80 cm scattered toner suction means GSA1 is fitted into air vent TKa.

The other end of scattered toner suction means GSa1 is connected to exhaust duct DHa.

Toner polluted air in the image forming apparatus is exhausted outside by fan HFa, through air vent TKa, scattered toner suction means GSa1, and exhaust duct DHa.

Developers (being toner), scattered in the image forming apparatus, are sucked out and accumulate in scattered toner suction means GSa1 as well as exhaust duct DHa, and thereby air vent TKa is blocked up.

In order to remove the accumulated toner (which are accumulated toner particles), periodical cleaning is essential.

However, conventional scattered toner suction means GSa 1 has a quite long duct and is not easily cleaned.

FIG. 2 shows developing device 4 incorporating scattered toner suction means GSa of the present invention.

Scattered toner suction means GSa of the present invention is composed of upstream air duct DTa 1, intermediate duct TDa and downstream air duct DTa 2.

One end of upstream air duct DTa1 is fitted into air vent TKa.

One end of intermediate duct TDa is removable from the connected end of upstream air duct DTa1.

The other end of intermediate duct TDa is removable from connected downstream air duct DTa2.

Downstream air duct DTa2 is easily removable from connected one end of exhaust duct DHa.

Toner polluted air in the image forming apparatus is exhausted to the outside by exhaust fan HFa, through air vent TKa, upstream air duct DTa1, intermediate duct TDa, downstream air duct DTA2, and exhaust duct DHa.

As shown in FIG. 3, intermediate duct TDa is structured of upper intermediate duct TDa1 and lower intermediate duct TDa2. Incidentally lower intermediate duct TDa2 is easily removed from upper intermediate duct TDa1.

Upper air duct DTa1 has elbow section E1 which is 20–30 mm from air vent TKa, and thereby a turbulent flow is generated in elbow section E1.

This turbulent air flow causes the blown toner particles to precipitate out.

Intermediate duct TDa has elbow section E2 which is 40–50 mm from air vent TKa, and thereby a turbulent flow is also generated in elbow section E2.

This turbulent air flow causes the flying toner particles to precipitate out.

Accordingly, the toner particles are conveyed along DTa1 and TDa1, and then precipitate out and accumulate in lower intermediate duct TDa2.

Further, since lower intermediate duct TDa2 is concave, the precipitated toner particles tend to accumulate in intermediate duct TDa2.

Still further, the toner particles accumulated in this concave section do not disturb the air flow, and thereby air vent TKa tends not to be blocked up.

Since lower intermediate duct TDa2 is easily removable from upper intermediate duct TDa1, it is very easy to remove the accumulated toner particles whenever required.

Maintenance of the developing device is simplified by this embodiment of the present invention.

As mentioned above, by the present invention, the scattered toner particles do not block the air vent, and it is very easy to clean the developing suction and the air duct of the image forming apparatus.

What is claimed is:

1. An image forming apparatus, comprising:

an image carrier;

a charging device for evenly charging the image carrier;

an image writing device for forming latent images on the image carrier which is charged by the charging device;

a developing device for forming toner images on the image carrier by developing the latent images formed on the image carrier, including:

a developing roller on which toner is formed by magnetic power, a housing to house toner agitating screws and the developing roller, and an air vent, mounted onto the housing near a gap between the developing roller and the image carrier, a transfer section for transferring the toner images onto a transfer material;

a fixing device for fixing the toner images on the transfer material; and a suction section, having one end fitted onto the air vent, wherein air including toner particles flows through the suction section, and toner particles scattered in the image forming apparatus accumulate in the suction section, including:

an upstream side duct having one end fitted onto the air vent;

an intermediate duct having one end fitted onto a second end of the upstream side duct comprising:

an upper intermediate duct for guiding air including the toner particles, and a lower intermediate duct in which the toner particles accumulate;

a downstream side duct having one end fitted onto a second end of the intermediate duct; and an exhaust fan which is connected to a second end of the downstream side duct for sucking air including the toner particles from the air vent through the suction section, and discharging air outside the image forming apparatus.

2. The image forming apparatus of claim 1, wherein the intermediate duct is formed in an elbow shape.

3. The image forming apparatus of claim 1, wherein the lower intermediate duct is concave in which the toner particles accumulate.

4. The image forming apparatus of claim 1, wherein the lower intermediate duct is removable from the intermediate duct for recycling the accumulated toner particles.

* * * * *